United States Patent [19]

Stahlecker

[11] Patent Number: 4,831,816

[45] Date of Patent: May 23, 1989

[54] PROCESS AND AN ARRANGEMENT FOR PRODUCING TWO YARN COMPONENTS RESPECTIVELY

[75] Inventor: Fritz Stahlecker, Bad Ueberkingen, Fed. Rep. of Germany

[73] Assignee: Hans Stahlecker, Sussen, Fed. Rep. of Germany

[21] Appl. No.: 202,547

[22] Filed: Jun. 6, 1988

[30] Foreign Application Priority Data

Jun. 10, 1987 [DE] Fed. Rep. of Germany ..... 3719281

[51] Int. Cl.[4] ..... D01H 5/28; D02G 3/26

[52] U.S. Cl. ..... 57/328; 57/293; 57/352

[58] Field of Search ..... 57/3, 13, 14, 210, 227, 57/228, 328, 329, 330, 331, 293, 294, 297, 352

[56] References Cited

U.S. PATENT DOCUMENTS

| | | | |
|---|---|---|---|
| 3,822,543 | 7/1974 | Edagawa et al. | 57/328 X |
| 4,084,400 | 4/1978 | Movschovich et al. | 57/293 |
| 4,450,675 | 5/1984 | Petrov et al. | 57/328 X |
| 4,484,436 | 11/1984 | Nakayama et al. | 57/328 |
| 4,495,761 | 1/1985 | Nakayama et al. | 57/328 |
| 4,574,579 | 3/1986 | Chao | 57/328 |
| 4,596,115 | 6/1986 | Maeda | 57/289 |
| 4,761,946 | 8/1988 | Stahlecker | 57/328 |

*Primary Examiner*—Donald Watkins
*Attorney, Agent, or Firm*—Barnes & Thornburg

[57] ABSTRACT

In the case of a process and an arrangement of producing spools containing two yarn components respectively and serving as feed spools for a twisting process, it is provided that the two yarn components that are each prestrengthened by means of false-twisting nozzles, are guided between a drafting frame and the spool on paths of different lengths, so that nonuniformities of the two yarn components that may have occurred during the drawing are not disposed directly next to one another.

9 Claims, 2 Drawing Sheets

PROCESS AND AN ARRANGEMENT FOR PRODUCING TWO YARN COMPONENTS RESPECTIVELY

BACKGROUND AND SUMMARY OF THE INVENTION

The invention relates to a process and an arrangement for producing spools containing two yarn components respectively and serving as feed spools for a twisting process, these two yarn components being drawn by means of adjacent drafting frames of a joint machine, then being prestrengthened by means of pneumatic false-twisting nozzles, and subsequently being cross-wound onto a spool.

In the case of a process and an arrangement of the initially mentioned type (German Patent Application No. P 36 06 932.9 corresponding to my commonly owned pending United States patent application Ser. No. 013,798 filed Feb. 12, 1987) the two yarn components are each drawn to the desired size in the drafting frames. Subsequently, they are prestrengthened in false-twisting nozzles, in which case this prestrengthening is carried out only to such an extent that the two yarn components together have a sufficient strength in order to be wound up and then be subjected to a subsequent twisting process. During this prestrengthening, the yarn components are not provided with a true twist. By means of the false twist, the yarn components are prestrengthened in such a way that, when the false twist is undone, several spread-away fiber ends are wound around the essentially untwisted fiber core. During the subsequent twisting, therefore practically no twist must be undone, so that the prestrengthening by pneumatic false-twisting as well as the subsequent twisting may each be carried out at very high production speeds. In the case of this arrangement, the drafting frames and the false-twisting nozzles are arranged in such a way that the same yarn-moving paths are obtained for both yarn components to the spool onto which they are cross-wound.

Even if the drafting frames are designed as well as possible, defective drafts will still occur occasionally. Since the two jointly wound-up yarn components have drafting frames with joint bottom cylinders and, as a rule, are also equipped with top rollers that are combined to pressure roller duos, the danger exists that defective drafts of this type occur simultaneously at both yarn components. These defective drafts will then be doubled in the double yarn and may have a disadvantageous effect.

An objective of the invention is to develop a process and an arrangement of the initially mentioned type in such a way that an occurrence of defective drafts does not result in more serious defects in the finished yarn.

This objective is achieved by guiding the two yarn components between the drafting frames and the spool on paths of a different length.

As a result, it is achieved that in the drafting frames thick or thin points produced simultaneously in both yarn components are not located directly next to one another in the later-formed double yarn, but at a distance in moving direction of the yarn that is determined by the paths of different lengths. Thus, the quality can be improved of a twist-type finished product that is produced from the double yarn.

In the case of a preferred arrangement for achieving this objective, it is provided that, between the drafting frames and the devices for the winding-up of two yarn components, at least for one of the yarn components, guiding elements are provided that determine yarn paths of different lengths for the two yarn components. In the case of a first embodiment, it is provided in this case that the false-twisting nozzles extend toward one another at an acute angle in moving direction of the yarn, and that guiding elements are arranged between the drafting frames and a withdrawal device that is common for both yarn components. In the case of another embodiment, it is provided that, between the common devices for the winding-up of the two yarn components and the respectively separate withdrawal devices, guiding elements are arranged for at least one of the yarn components.

In a further embodiment of the invention, it is provided that the wind-up device for the common spool is arranged as a straight-line extension of the drafting frame and of the pertaining false-twisting nozzle of one yarn component, and that the guiding elements are assigned to the other yarn component. As a result, a slightly asymmetrical arrangement is obtained which, however, implements the different yarn moving paths in a simple way.

Other objects, advantages and novel features of the present invention will become apparent from the following detailed description of the invention when considered in conjunction with the accompanying drawings.

DETAILED DESCRIPTION OF THE DRAWINGS

To the extent that in the following embodiments reference is made to identical or almost identical components, the same reference symbols are used.

Figure 1:
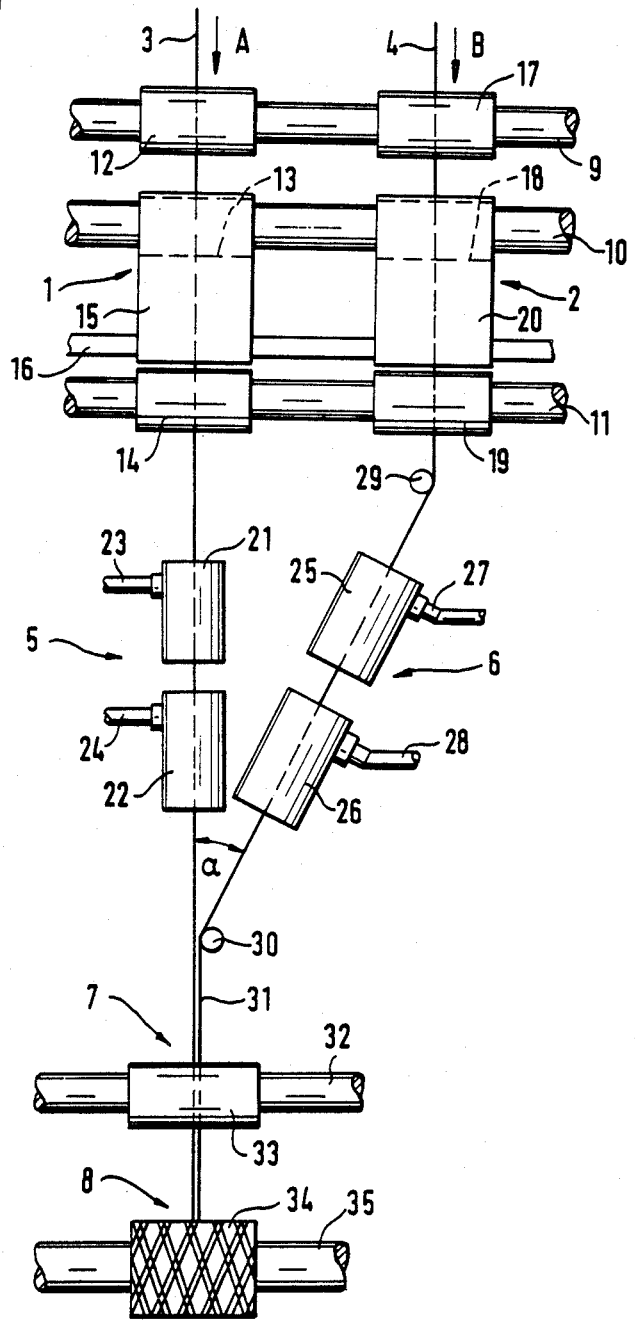
FIG. 1 is a schematic view of an arrangement according to a preferred embodiment of the invention, in which the yarn moving paths of different lengths are produced between the drafting frames and a withdrawal device in the area of the false-twisting nozzles.

The arrangement according to FIG. 1 contains two drafting frames 1, 2 arranged next to one another to which, in each case, one yarn component 3, 4 is fed as a sliver in moving direction (A,B) of the yarn. In the drafting frames 1, 2, the yarn components 3, 4 are drawn to the desired yarn size.

Separate prestrengthening zones 5, 6 for the two yarn components 3, 4 are connected behind the drafting frames 1, 2. The two prestrengthened yarn components 3, 4 subsequently are withdrawn by means of a common withdrawal device 7 and, by means of a wind-up device 8, are jointly cross-wound onto a spool 34 which later is used as a feed spool for a twisting in which the final yarn is produced that has a twist-type quality.

The drafting frames 1, 2, that are in each case assigned to the two yarn components 3, 4, that are to be wound up jointly, have common bottom cylinders 9, 10, 11 that pass through in the longitudinal direction of the machine and that also serve as bottom cylinders 9, 10, 11 for the drafting frames 1, 2, for the adjacent work positions. The bottom cylinders 9, 10, 11, in a known way, are driven in a headstock of the machine. Top rollers 12, 13, 14 are assigned to the drafting frame 1 of the yarn component 3. In addition, apron guides are assigned to the main drafting zone, of which a top apron 15 as well as a deflecting rail 16 for an invisible bottom apron are visible. In an identical way, the drafting frame 2 contains top rollers 17, 18, 19 as well as a top apron 20 and a bottom apron that is not visible. The top rollers 12, 17; 13, 18; 14, 19 are usually combined into so-called pressure roller duos.

The prestrengthening zones 5, 6 contain two air nozzles 21, 22; 25, 26 respectively. The air nozzles 21, 22; 25, 26 are connected to compressed-air feeding pipes 23, 24, 27, 28. The are nozzles 21, 25 that, in each case, are first in moving direction (A,B) of the yarn essentially have the task of sucking in the yarn components 3 or 4 and, as desired, loosening them up slightly. In the area of these air nozzles 21, 25, practically no false twist is yet applied to the yarn components 3, 4. The providing of the false twist takes place in the air nozzles 22, 26 that generate an air whirl of an indicated direction of rotation. After leaving the air nozzles 22, 23, the false twist provided to the yarn components 3, 4 opens up again, the fiber ends, however, remaining wound around the respective fiber components 3, 4 so that a prestrengthening is achieved.

As shown in FIG. 1, the two air nozzles 21, 22 follow the pertaining drafting frame 1 of the yarn component 3 as a straight-line extension, while the direction of the two air nozzles 25, 26, with respect to the straight-line extension of the pertaining drafting frame 2, bends in such a way that the two false-twisting zones 5, 6 converge at an acute angle ($\alpha$). Between the pair 11, 19 of delivery rollers of the drafting frame 2 and the air nozzle 25 that follows, a deflecting element 29 is arranged. Following air nozzle 26, another deflecting element 30 is arranged in such a way that yarn component 4 extends very closely to yarn component 3 without, however, coming in contact with it at this point. The two yarn components 3, 4, behind the guiding element 30, move to the withdrawal device 7 in the form of a double yarn 31, this withdrawal device 7 being a straight-line extension of the prestrengthening zone 5. The withdrawal device 7 comprises a driven shaft 32 passing through in the longitudinal direction of the machine and of a pressure roller 33. Connected behind the withdrawal device 7 is the wind-up device 8, also as a straight-line extension of the drafting frame 1 and of the prestrengthening zone 5, which contains a driven shaft 35 passing through in the longitudinal direction of the machine. The spool 34, onto which the double yarn 31 is cross-wound, in a way that is not shown in detail, is held by a spool frame and driven by the shaft 35.

As shown in FIG. 1, the yarn moving path for the yarn component 4 behind drafting frame 2 is longer than the yarn moving path for the yarn component 3 behind drafting frame 1. Defective drafts that may possibly occur simultaneously in drafting frames 1, 2 and that are represented by thick or thin points, as a result of the asymmetrical yarn paths, will not be located directly next to one in another in the yarn components 3, 4 in the double yarn 31 and thus also not in the spool 34, but will be located at a sufficient distance behind one another.

Figure 2:
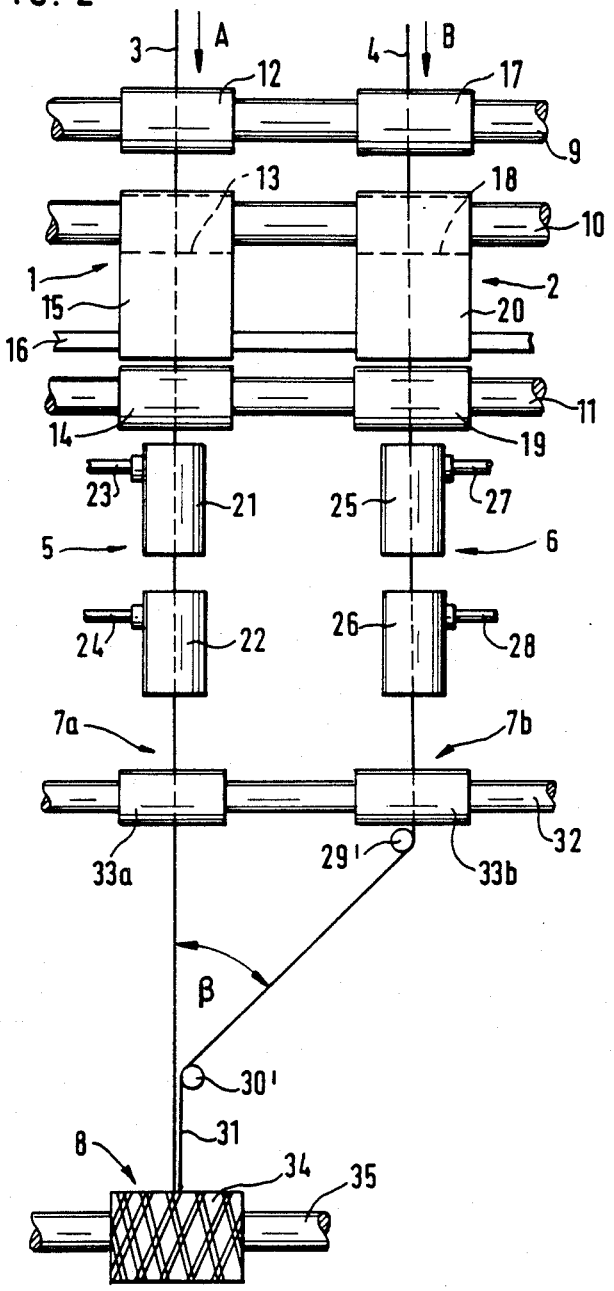
FIG. 2 is a schematic view of an arrangement according to another preferred embodiment of the invention, in which the yarn moving paths of different lengths are produced between a spool and the withdrawal device in front of it.

In the case of the embodiment according to FIG. 2, drafting frames 1, 2 are also provided that, in a corresponding way, are followed by prestrengthening zones 5, 6. The prestrengthened yarn components 3, 4, in the form of a double yarn 31, are wound by means of a wind-up device 8, onto a spool 34 that is used as a feed spool for a twisting process. In the case of the embodiment according to FIG. 2, however, it is provided that the air nozzles 21, 22 and 25, 26, in each case, extend as a straight-line extension of the pertaining drafting frames 1, 2. Each of these prestrengthening zones 5, 6 is followed by a separate withdrawal device 7*a*, 7*b* which comprises a driven shaft 32 passing through in the longitudinal direction of the machine and respective separate pressure rollers 33*a*, 33*b*.

The two yarn components 3, 4 are guided together to form a double yarn 31 no earlier than behind the withdrawal devices 7*a*, 7*b* and in front of the wind-up device 8. This takes place by means of guiding elements 29', 30' that are assigned to the yarn component 4. As shown in FIG. 2, the yarn components 3, 4 converge at an acute angle ($\beta$) that is somewhat larger than in the case of the embodiment according to FIG. 1. Also in the case of this embodiment, it is achieved that possibly simultaneously occurring defective drafts do not cause thick points or thin points that are located directly next to one another in the yarn components 3, 4 forming the double yarn 31. As a result of the longer yarn moving path for yarn component 4, it is achieved that thin or thick points of this type are located at a distance behind one another in the double yarn 31 and correspondingly are also later twisted together at this distance.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A process for producing spools containing two yarn components respectively and serving as a feed spool for a twisting process, these two yarn components being drawn by means of adjacent drafting frames of a joint machine, then being prestrengthened by means of pneumatic false-twisting nozzles, and subsequently being cross-wound onto a spool, wherein the two yarn components are guided between the drafting frames and the spool on paths of a different length.

2. A process according to claim 1, wherein one of the yarn components is guided in a straight line from the drafting frame to the spool, and wherein the other of the yarn components is guided from the frame at an acute angle with respect to the straight line along a portion of its path from the drafting frame to the spool.

3. A process according to claim 2, wherein said portion of the path of the other of the yarn components is located between the drafting frame and a guide roller disposed downstream of the false twisting nozzles.

4. A process according to claim 2, wherein said portion of the path of the other of the yarn components is located between a withdrawal roller pair located downstream of the false twisting nozzles and a guide roller adjacent the spool.

5. An arrangement for producing spools containing two yarn components respectively and serving as feed spools for a twisting process, comprising drafting frames for drawing the yarn components, pneumatic false-twisting nozzles downstream of the drafting frames, yarn withdrawal devices for withdrawing the yarn components, and cross-winding devices for the cross-winding of two yarn components respectively onto a spool, wherein, between the drafting frames and the devices for the winding-up of the two pertaining yarn components, guiding elements are arranged for at least one of the yarn components, these guiding elements determining yarn moving paths of different lengths for the two yarn components.

6. An arrangement according to claim 5, wherein the false-twisting nozzles converge at an acute angle in the moving direction (A, B) of the yarn, and in that guiding elements are arranged between the drafting frames and a withdrawal device common to both yarn components.

7. An arrangement according to claim 5, wherein guiding elements are arranged for at least one of the yarn components between the common devices for the winding-up of the two yarn components and respectively separate withdrawal devices.

8. An arrangement according to claim 6, wherein the wind-up device for the joint spool is arranged as a straight-line extension of the drafting frame and of the pertaining false-twisting nozzle of one yarn component, and wherein the guiding elements are assigned to the other yarn component.

9. An arrangement according to claim 7, wherein the wind-up device for the joint spool is arranged as a straight-line extension of the drafting frame and of the pertaining false-twisting nozzle of one yarn component, and wherein the guiding elements are assigned to the other yarn component.

* * * * *